US006663443B1

(12) United States Patent
Smith et al.

(10) Patent No.: US 6,663,443 B1
(45) Date of Patent: Dec. 16, 2003

(54) LAY-IN ELECTRICAL CONNECTOR WITH A DETACHABLE TANG

(75) Inventors: William Smith, Cincinnati, OH (US); Dave Wood, Westchester, OH (US); Bill Wolins, Cincinnati, OH (US)

(73) Assignee: Ilson Corporation, Cincinnati, OH (US)

( * ) Notice: Subject to any disclaimer, the term of this patent is extended or adjusted under 35 U.S.C. 154(b) by 0 days.

(21) Appl. No.: 10/231,665

(22) Filed: Aug. 30, 2002

(51) Int. Cl.[7] ..... H01R 4/36
(52) U.S. Cl. ..... 439/811; 439/810; 439/812
(58) Field of Search ..... 439/811, 814, 439/810, 739, 797, 816

(56) References Cited

U.S. PATENT DOCUMENTS

| | | | | | |
|---|---|---|---|---|---|
| 2,193,202 | A | | 3/1940 | Millermaster | |
| 3,335,399 | A | | 8/1967 | Rys | |
| 3,344,394 | A | | 9/1967 | Kingsbury | |
| 3,585,332 | A | | 6/1971 | Dries | |
| 3,715,707 | A | * | 2/1973 | Anderson | 439/721 |
| 3,742,431 | A | | 6/1973 | Kobyner | |
| 3,760,342 | A | * | 9/1973 | Prouty et al. | 439/86 |
| 3,836,941 | A | * | 9/1974 | Izraeli | 439/431 |
| 3,876,279 | A | | 4/1975 | Underwood | |
| 4,135,777 | A | * | 1/1979 | Barth | 439/782 |
| 4,236,778 | A | * | 12/1980 | Hughes et al. | 439/406 |
| 4,603,376 | A | | 7/1986 | Maier | |
| 4,989,118 | A | * | 1/1991 | Sorenson | 361/673 |
| 5,041,026 | A | | 8/1991 | Hansel | |
| 5,269,710 | A | * | 12/1993 | Donnerstag | 439/810 |
| 5,368,506 | A | * | 11/1994 | Heimbrock | 439/813 |
| 5,599,211 | A | * | 2/1997 | Kurahashi et al. | 439/806 |
| 5,704,815 | A | * | 1/1998 | Shibata et al. | 439/709 |

* cited by examiner

*Primary Examiner*—Chandrika Prasad
(74) *Attorney, Agent, or Firm*—Wood, Herron & Evans, L.L.P.

(57) ABSTRACT

A lay-in electrical connector having a lug body with multiple dividing walls defining multiple conductor-receiving channels, multiple lug caps each associated with one of the conductor-receiving channels, and a tang secured with the lug body. The electrical connector is free of welded joints as the tang is coupled with the lug body by a clamping force applied by binding screws of the lug caps to conductors positioned within corresponding ones of the conductor-receiving channels. The tang, including the mounting holes extending through the tang, may be formed by an extrusion process. A removable plug element is provided for holding the lug caps and/or tang in a pre-assembled relationship with the lug body prior to use.

23 Claims, 4 Drawing Sheets

LAY-IN ELECTRICAL CONNECTOR WITH A DETACHABLE TANG

FIELD OF THE INVENTION

The present invention relates to electrical connectors and, in particular, to lay-in electrical connectors.

BACKGROUND OF THE INVENTION

Lay-in electrical connectors are frequently used for securing large gauge conductors that are stiff and difficult to handle as compared with smaller diameter conductors that are readily deformed and contorted for securement. Lay-in electrical connectors generally include a lug body having a channel-shaped wireway, a top screw-threaded lug cap received and captured within the wireway, and a binding screw extending through the lug cap to be tightened against a conductor or conductors laid in the wireway. The wireway is provided with opposed upstanding walls each having an inwardly-oriented groove that captures a corresponding one of opposite side flanges provided on the lug cap. The grooves of the wireway cooperate with the side flanges of the lug cap to resist upward movement of the lug cap as the binding screw is tightened.

The lay-in style of electrical connectors is characterized in that the lug cap may be separated from the lug body when a conductor is to be laid into place between the upstanding walls of the lug body. As a result, the conductor does not have to be forced into the entrance of the wireway. After the conductor is positioned in the wireway, the side flanges of the lug cap are engaged with the grooves of the wireway and the lug cap is slidingly shifted into position over the conductor. The binding screw is tightened to apply a clamping force to the inserted conductor that presses the conductor against the floor of the wireway. The clamping force creates an assembly of the lug cap and lug body.

Certain lay-in style electrical connectors include multiple wireways each capable of accepting a conductor. One significant disadvantage of multi-conductor lay-in electrical connectors is the multiplicity of components. Associated with each wireway is an independent lug cap carrying at least one binding screw. The electrical connector is typically shipped from the manufacturer as a group of loose components, which may become separated during shipment and lost. As a result, workers installing multi-conductor lay-in electrical connectors may lack all components needed for the installation. Even if all components are available, the worker must track the various components during assembly. Often, the components are misplaced or mislaid. Therefore, it is of considerable practical importance to maintain assembly of the parts of a lay-in electrical connector when it is not in use.

Multi-conductor lay-in electrical connectors include a tang that incorporates multiple mounting openings used to secure the electrical connector to a supporting structure or device with conventional fasteners. Such electrical connectors find use in the utility industry for attachment to, for example, a spade mount bushing on a transformer. Although the screw-threaded cap and connector body may be formed as extruded components, the tang must be machined in its entirety from metal stock. As a result, the tang is relatively expensive to manufacture. Moreover, the tang is typically welded to the connector body which adds a manufacturing step and increases the labor costs incurred to perform the welding operation.

Therefore, there is a need for a multi-conductor lay-in electrical connector having a tang that is removably coupled with the lug body and formed by extrusion, and for a device that can maintain the components of the lay-in electrical connector united with the lug body before installation.

SUMMARY OF THE INVENTION

The invention is related to a lay-in electrical connector configured to accept multiple conductors. According to the principles of the invention and in one embodiment, the lay-in electrical connector includes a body member or lug body having a plurality of dividing walls defining a plurality of conductor-receiving channels each capable of receiving a conductor, a plurality of cap members or lug caps each configured to be engaged with a corresponding one of the conductor-receiving channels, and a tang configured to be engaged with the body member. Each of the cap members has a binding screw capable of being tightened to capture the conductor in the conductor-receiving channel. The tang includes an attachment pad with at least one mounting hole and a plurality of fingers extending from a side edge of the attachment pad. Each of the plurality of fingers is positioned between adjacent ones of said dividing walls when the tang is engaged with the body member. When the binding screw is tightened, the conductor received within the corresponding one of the conductor-receiving channels is captured between one of the fingers and the binding screw of the cap member. In certain embodiments of the invention, at least the tang is formed by an extrusion process and, in other embodiments of the invention, the mounting holes in the attachment pad of the tang are formed during the extrusion process forming the tang.

Forming the tang by extrusion reduces the manufacturing costs for the multi-conductor lay-in electrical connector and expands the flexibility for its use. Moreover, in certain embodiments of the invention, the mounting holes of the attachment pad are created during the extrusion process so that the tang may be formed without any significant additional machining or drilling which reduces the expense of the manufacturing process. In addition, the electrical connector of the invention is free of welded joints because the tang is held in place by an assembly force supplied by the engagement between the binding screws and the conductor in the conductor-receiving channel.

According to the principles of the invention, a lay-in electrical connector is provided that includes a body member having a conductor-receiving channel capable of receiving a conductor and a cap member removably received in a portion of the conductor-receiving channel. The cap member has a binding screw capable of being tightened to secure the conductor positioned in the conductor-receiving channel. The electrical connector further includes a plug removably positioned in the conductor-receiving channel. The plug is configured to be contacted by the binding screw for captivating the cap member with the body member.

According to the principles of the invention, the removable plug reduces labor costs associated with installation of a lay-in electrical connector having at least one removable cap member or lug cap and simplifies the installation process. In particular, the removable plug permits the lug cap to be associated with the body member or lug body in a pre-assembled condition for storage and shipment after manufacture. To that end, the removable plug captivates the lug cap with the lug body without advancing the binding screw(s) to contact the lug body for holding the assembly together. As a result, the binding screw(s) are suspended in a position ready for securing a conductor in the conductor-receiving channel without withdrawing or otherwise moving the binding screw(s) after the plug is removed. After the lug cap is disengaged from the lug body and the plug is removed, the lug cap can then be re-engaged with the lug body in a position suitable for engaging the binding screws with the conductor without manipulating the binding screws to avoid the obstruction presented by the conductor during re-engagement.

The objects and advantages of the present invention will be further appreciated in light of the following detailed description and drawings in which:

DETAILED DESCRIPTION

Although the invention will be described next in connection with certain embodiments, the invention is not limited to practice in any one specific type of lay-in style electrical connector. It is contemplated that the principles of the invention can be used with a wide variety of lay-in style electrical connectors. The description of the invention is intended to cover all alternatives, modifications, and equivalent arrangements as may be included within the spirit and scope of the invention as defined by the appended claims. In particular, those skilled in the art will recognize that the components of the invention described herein could be arranged in multiple different ways.

Figure 1:
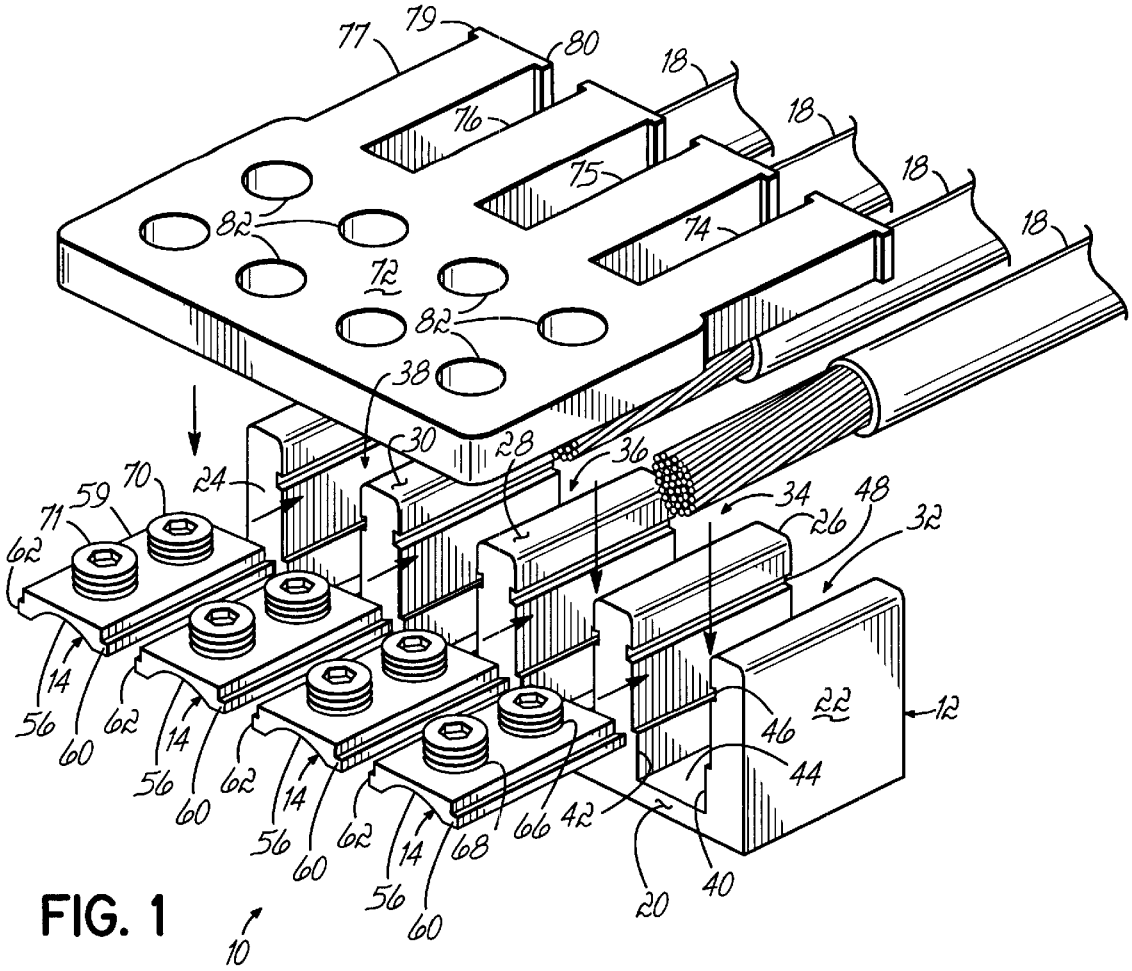
FIG. 1 is a disassembled perspective view of a multi-conductor lay-in electrical connector in accordance with the principles of the invention.
Figure 2:
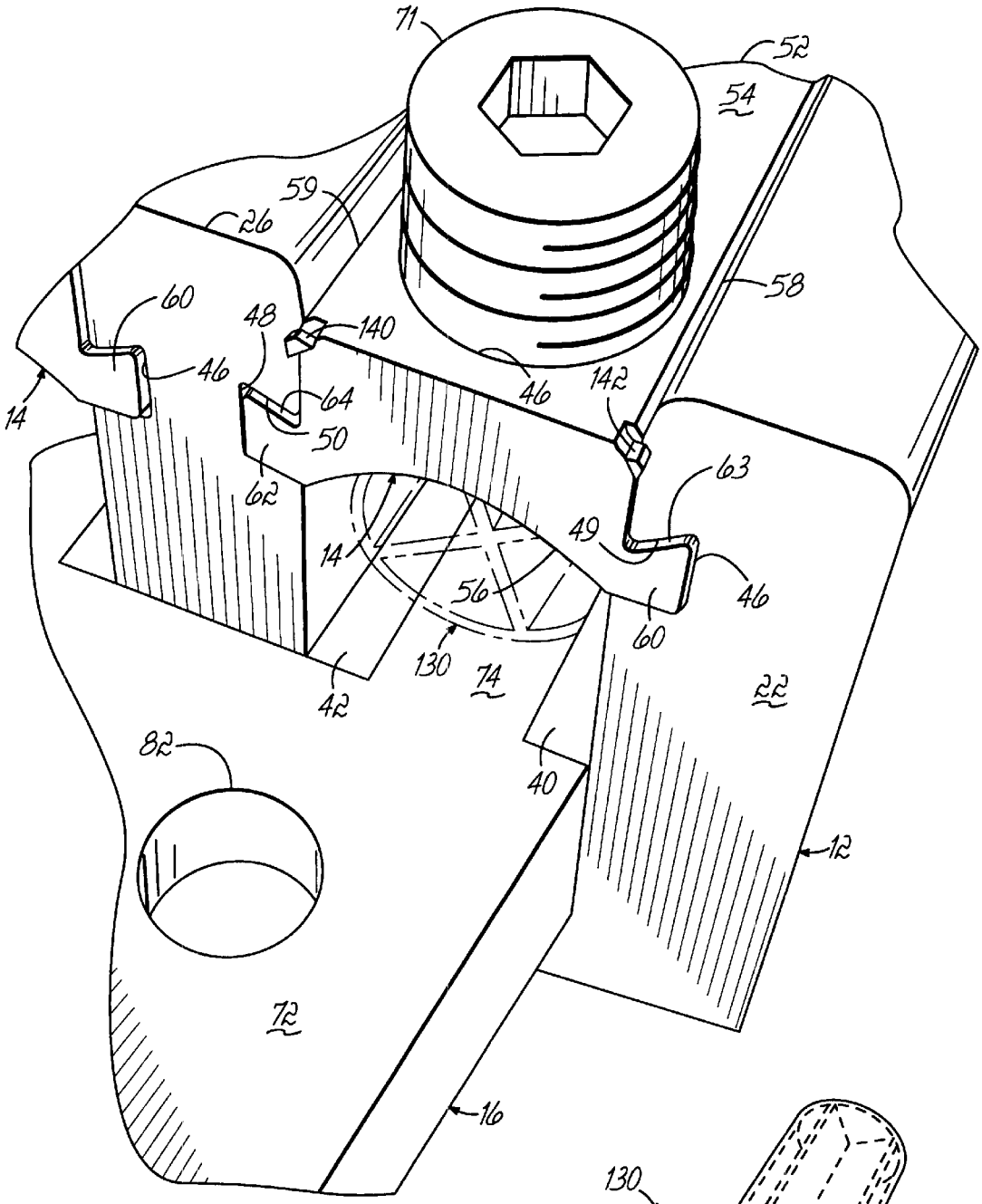
FIG. 2 is a perspective view of a portion of the electrical connector of FIG. 1 shown with the corresponding conductor absent from the conductor-receiving channel, with the lug caps engaged with the lug body, and with a disposable plug positioned in the conductor-receiving channel.

With reference to FIGS. 1 and 2, a lay-in electrical connector 10 of the invention is an assembly including a body member or lug body 12, multiple cap members or lug caps 14 removably coupled with the lug body 12, and a spade or tang 16 also removably coupled with the lug body 12. The tang 16 is used to mount the electrical connector 10 in a low-resistance, current-carrying electrical connection with a support surface of a device (not shown), such as a transformer, capable of being energized. The electrical connector 10 operates to transfer or distribute electrical current from the energizeable device to multiple conductors 18, typically either aluminum or copper, each secured in electrical continuity with the lug body 12 by a corresponding one of the lug caps 14.

The lug body 12 includes a horizontal base wall 20, a pair of vertical outer dividing walls 22, 24 extending away from the base wall 20, and a plurality of, for example, three inner dividing walls 26, 28, 30 extending vertically away from the base wall 20. The inner dividing walls 26, 28, 30 are positioned peripherally between the outer dividing walls 22, 24 and partition the transverse space between the outer walls 22, 24 into a plurality of open-ended wireways or conductor-receiving channels 32, 34, 36, 38. The vertical ends of the outer and inner dividing walls 22, 24, 26, 28, 30 opposite the base wall 20 are not interconnected so that a corresponding one of the conductors 18 can be placed vertically into the corresponding one of the conductor-receiving channels 32, 34, 36, 38, which is a feature characteristic of lay-in electrical connectors. The transverse spacing between adjacent pairs of dividing walls 26, 28, 30 is sufficient to permit vertical placement of the respective one of conductors 18 into each of the conductor-receiving channels 32, 34, 36, 38, when the corresponding one of the lug caps 14 is removed.

The structure of the lug body 12 within conductor-receiving channel 32 is substantially identical to the structure within each of the conductor-receiving channels 34, 36, 38. Therefore, the following description relating to conductor-receiving channel 32 is equally applicable to channels 34, 36, 38. Extending upwardly away from the base wall 20 with conductor-receiving channel 32 is a pair of opposed shoulders 40, 42. The opposed shoulders 40, 42 flank a flat-bottomed, slot-like passageway 44 that extends lengthwise along the conductor-receiving channel 32 and that is aligned generally parallel to the longitudinal centerline of channel 32. The passageway 44 has a uniform width in a direction transverse to the conductor-receiving channel 32 that is less than a width of the conductor-receiving channel 32.

With continued reference to FIGS. 1 and 2, provided on a side surface of inner dividing wall 26 and on an inwardly-facing side surface of outer dividing wall 22 are respective channels 46, 48 that open into conductor-receiving channel 32. Each channel 46, 48 is spaced vertically upward from the corresponding shoulder 40, 42 and extends the length of the conductor-receiving channel 32. The channels 46, 48 are confronting and are aligned substantially parallel with each other and relative to a longitudinal axis aligned with the centerline of the conductor-receiving channel 32. Each channel 46, 48 is bounded upwardly by a respective downwardly-facing cam or contact surface 49, 50 (FIG. 2) angled with a downward inclination angle.

Each lug cap 14 is a generally rectangular body 52 having a planar upper surface 54 and an arcuate lower surface 56 that are connected by opposed side surfaces 58, 59. Each lug cap 14 is configured to be removably associated with one of the conductor-receiving channels 32, 34, 36, 38. To that end, a pair of side flanges 60, 62 project outwardly in opposite directions from the opposed side surfaces 58, 59 of each lug cap 14. The side flanges 60, 62 are generally parallel and are of sufficient width and height to provide a sliding fit with the channels 46, 48 of the lug body 12. Each of the side flanges 60, 62 has an upwardly-facing cam or contact surface 63, 64 inclined with an angle corresponding to the inclination angle of corresponding contact surfaces 49, 50. When the lug cap 14 is engaged with the lug body 12, the side flanges 60, 62 slidingly engage the channels 46, 48 in a direction parallel to the corresponding one of the conductor-receiving channels 32, 34, 36, 38 such that each of the side flanges 60, 62 is captured against vertical movement. The engagement between the contact surfaces 49, 50 and the contact surfaces 63, 64 facilitate assembly of the electrical connector 10 by promoting efficient transfer of the torque of binding screws (to be discussed below) to the conductor 18 and facilitate assembly of the components of the electrical connector 10. After engagement, the arcuate lower surface 56 of each lug cap 14 spans, and provides an upper boundary for, the respective one of the conductor-receiving channels 32, 34, 36, 38 and overlies the corresponding passageway 44.

With continued reference to FIGS. 1 and 2, each lug cap 14 includes a longitudinally-spaced pair of threaded openings 66, 68 each of which are configured to intermesh or mate with complementary threads on a corresponding one of the pair of binding screws 70, 71. A vertical centerline of each threaded opening 66, 68 is oriented substantially orthogonal to a horizontal or longitudinal centerline of the conductor-receiving channels 32, 34, 36, 38 with which the respective lug cap 14 is associated, when the lug cap 14 is engaged with the lug body 12. When the binding screws 70, 71 are advanced downwardly against the conductor 18 in the corresponding one of the conductor-receiving channels 32, 34, 36, 38, the lug cap 14 moves upwardly relative to the lug body 12 and the respective pairs of contact surfaces 49, 50 and contact surfaces 63, 64 engage. It is appreciated that the lug cap 14 may include any number of threaded openings and associated binding screws without departing from the spirit and scope of the invention.

The tang 16 includes a generally rectangular attachment pad 72 and a plurality of, for example, four fingers or tines 74, 75, 76, 77 projecting outwardly and generally parallel to each other from one side margin or edge 78 of the circumference of the attachment pad 72. The tines 74, 75, 76, 77 and the attachment pad 72 are formed as an integral structure by an extrusion process creating the tang 16. The generally-rectangular tines 74, 75, 76, 77 are spaced in a transverse direction such that each tine 74, 75, 76, 77 is received within a corresponding one of the conductor-receiving channels 32, 34, 36, 38 when the tang 16 is engaged with the lug body 12. To that end, the dimension of the tines 74, 75, 76, 77 and the spacing between the adjacent pairs of tines 74, 75, 76, 77 provides a snug fit with the respective passageway 44 of the conductor-receiving channels 32, 34, 36, 38 when the tang 16 is engaged with the lug body 12.

With continued reference to FIGS. 1 and 2, a free end of each tine 74, 75, 76, 77 opposite the end attached to the attachment pad 72 includes a pair of side flanges 79, 80 that extend outwardly in opposite transverse directions. When the tang 16 is assembled with the lug body 12, the side edge 78 of the attachment pad 72 contacts the dividing walls 22, 24, 26, 28, 30 of lug body 12 about one entrance to each passageway 44 and the side flanges 79, 80 of each tine 74, 75, 76, 77 engage the dividing walls 22, 24, 26, 28, 30 about the opposite entrance to the passageway 44. The engagement prevents longitudinal movement of the tang 16 relative to the lug body 12, which is useful before the conductors 18 are received in the conductor-receiving channels 32, 34, 36, 38 and the lug caps 14 are installed. In particular, the engagement is useful for securing the tang 16 against the influence of gravity if the electrical connector 10 is mounted with the conductor-receiving channels 32, 34, 36, 38 oriented vertically.

The attachment pad 72 further includes a plurality of, for example, four spaced-apart mounting holes 82 each configured to receive one of a corresponding plurality of fasteners (not shown) for attaching and electrically coupling the lay-in electrical connector 10 with the intended device. Mounting holes 82 are arranged with a suitable hole pattern. In certain embodiments, the hole pattern or arrangement for the mounting holes 82 may comply with standard NEMA bolt hole sizing and spacing.

The lug body 12, lug cap 14, and tang 16 may each be formed by an extrusion process from a billet of an electrically-conductive material, such as a metal alloy. Suitable metal alloys include, but are not limited to, high strength aluminum alloys such as 6061-T6. Specifically, the lug body 12, lug cap 14, and tang 16 are produced by forcing a heated or cold billet of material to flow through a die in an extrusion press. The only features of the electrical connector 10 formed by a subsequent machining operation are the mounting holes 82 of the attachment pad 72 and the threaded openings 66, 68 that are drilled and tapped in the lug cap 14. Otherwise, the electrical connector 10 is formed free of machining or drilling.

Figure 3A:
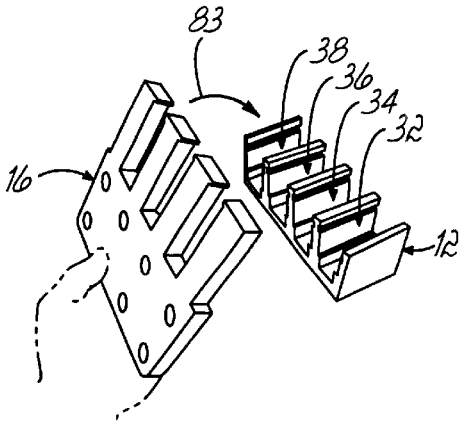
FIGS. 3A–3E are diagrammatic views illustrating assembly of the multi-conductor lay-in electrical connector of FIG. 1.
Figure 3B:
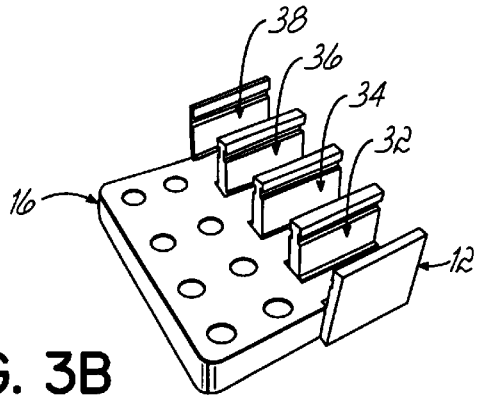
Figure 3C:
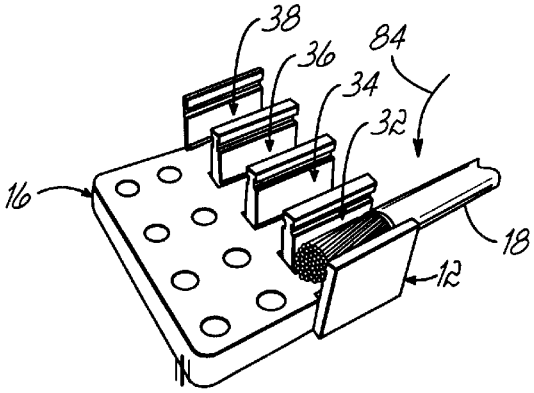
Figure 3D:
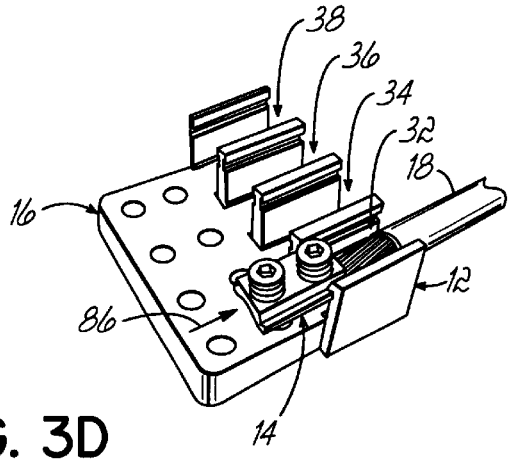
Figure 3E:
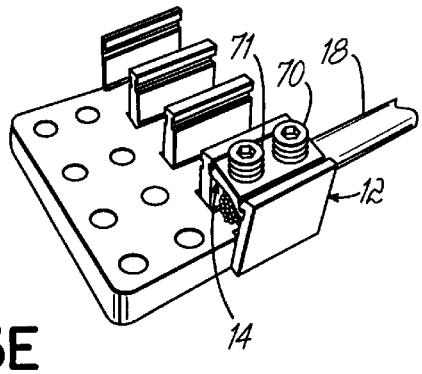

In use and with reference to FIGS. 3A–3E, an installation sequence is illustrated for the electrical connector 10. Initially and with reference to FIGS. 3A and 3B, the lug caps 14 are removed from the lug body 12. The tang 16 is moved generally in the direction of the arrow 83 to insert the tines 74, 75, 76, 77 between the dividing walls 22, 24, 26, 28, 30 and into the corresponding conductor-receiving channels 32, 34, 36, 38. It is appreciated that the mounting holes 82 of the attachment pad 72 may be attached to a mounting surface on an associated energizeable device before performing the installation sequence. Next and as shown in FIG. 3C, the bare end of conductor 18 is laid vertically, in the general direction of arrow 84, between the dividing walls 22 and 26 into conductor-receiving channel 32 and into contact with an upper surface of tine 74. With reference to FIGS. 3D, the lug cap 14 is slidingly coupled with the lug body 12 by movement in the general direction of arrow 86 so that the side flanges 60, 62 are engaged with the channels 46, 48. With reference to FIG. 3E, the binding screws 70, 71 are advanced against the conductor 18 to secure the conductor 18 with a binding force or tightening torque that also fixes the relative positions of the tang 16, lug body 12 and lug cap 14. A typical binding force is on the order of about 500 inch-pounds. The steps shown in FIGS. 3C–3E are repeated to place conductors 18 in the remaining conductor-receiving channels 34, 36, 38.

Figure 4:
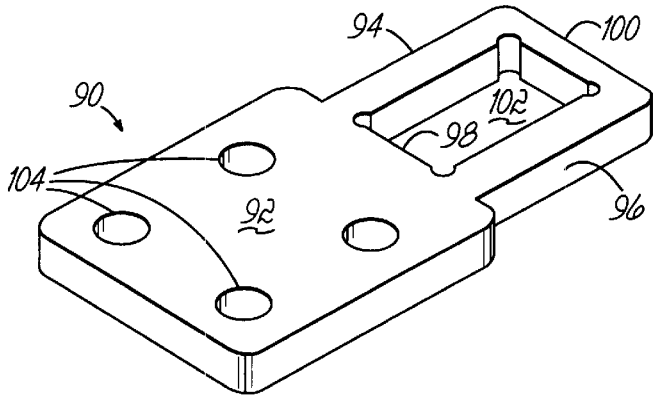
FIG. 4 is a perspective view of an alternative embodiment of a multi-conductor lay-in electrical connector in accordance with the principles of the invention.

With reference to FIG. 4 in which like reference numerals refer to like features in FIGS. 1 and 2, a tang 90 for use with lay-in electrical connector 10 includes an attachment pad 92 and a pair of substantially parallel tines 94, 96 extending outwardly from a side edge 98 of the attachment pad 92. The tines 94, 96 are joined at one end by an integral connecting member 100 so as to define a generally-rectangular opening 102 dimensioned and shaped to receive therein one of the inner dividing walls 26, 28, 30. The tines 94, 96 of the tang 90 are received by an adjacent pair of conductor-receiving channels 32, 34, 36, 38 when the appropriate pair of lug caps 14 is removed. Provided in the attachment pad 92 is a plurality of, for example, four mounting holes 104.

Figure 5:
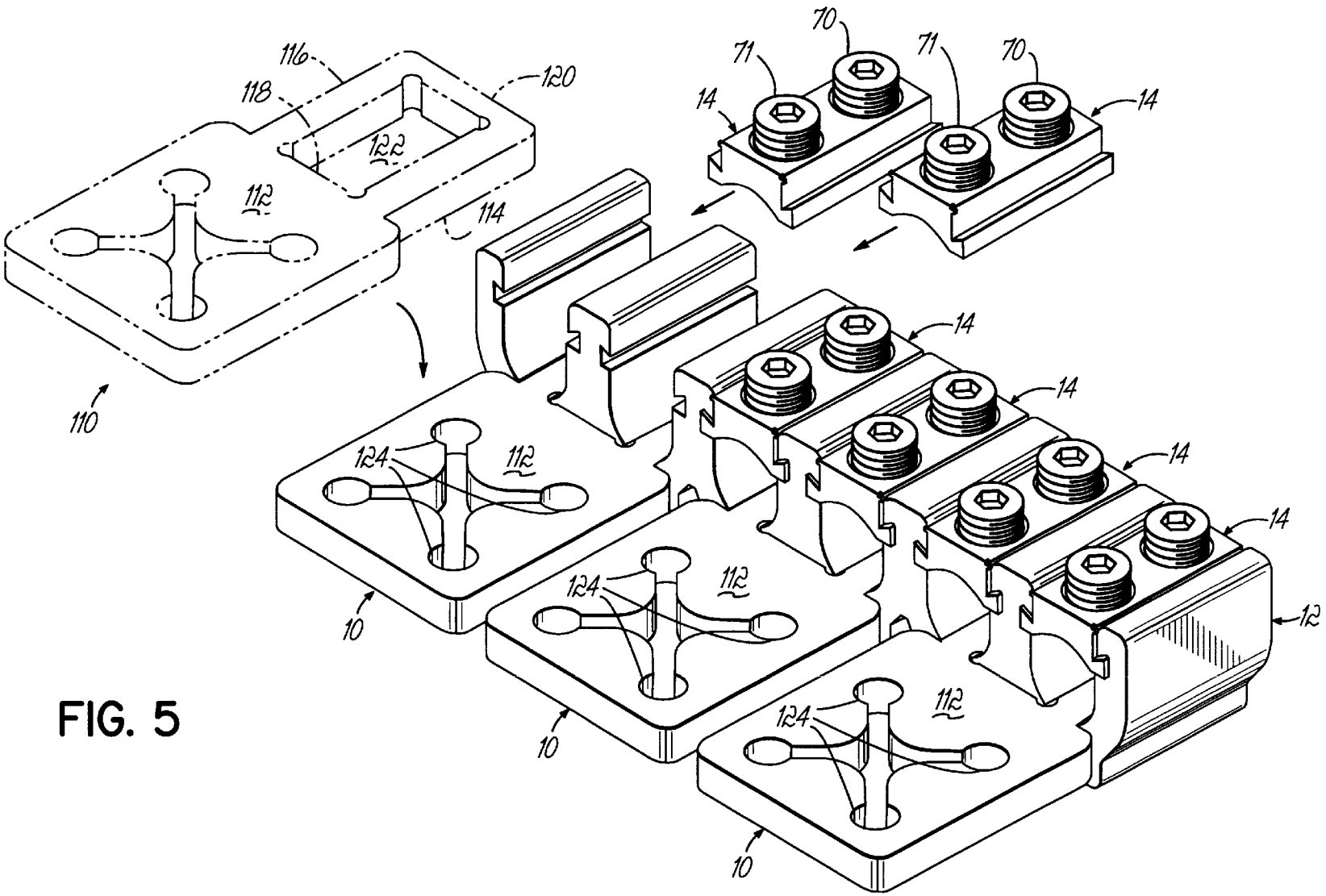
FIG. 5 is a perspective view of an alternative embodiment of a tang for use with the multi-conductor lay-in electrical connector of FIG. 4.

With reference to FIG. 5 in which like reference numerals refer to like features in FIG. 4, a tang 110 for use with lay-in electrical connector 10 includes an attachment pad 112, a pair of substantially parallel tines 114, 116 extending outwardly from a side edge 118 of the attachment pad 112, and an integral connecting member 120 joining one end of the tines 114, 116 to form a generally-rectangular opening 122. Provided in the attachment pad 112 is a plurality of, for example, four mounting holes 124 formed in a spaced pattern during an extrusion process forming the tang 110. To that end, the tang 110 is extruded as an extruded body by forcing a hot billet to flow through a die over a mandrel or arbor positioned centrally in the die. The mandrel is suitably shaped to provide the pattern of mounting holes 124. After forming, each extruded body is cut to a desired length to provide individual tangs 110. In certain embodiments, the hole pattern for the mounting holes 124 may comply with standard NEMA bolt hole sizing and spacing.

The lay-in electrical connector 10 of the invention may be constructed in accordance with American National Standards Institute (ANSI) or Underwriters Laboratories standards (UL), if it is contemplated that the invention will be used in the United States of America. Other standards are applicable in other countries, such as standards promulgated by the Canadian Standards Association (CSA). It is appreciated that the features of the electrical connectors may be scaled in size to correlate with a gauge of conductor or range of gauges being secured.

The lay-in electrical connectors of the invention have various advantages over conventional lay-in electrical connectors for multiple conductors. Specifically, in one embodiment, all three primary components of the lay-in lug, namely, the connector body, the screw-threaded cap and the tang(s), are formed by an extrusion process so that any machining is limited to slicing the appropriate extruded form and removing any burrs. In other embodiments, the machining is limited to providing mounting holes in the attachment pad of the tang.

In addition, the electrical connectors of the invention are free of welded joints because the tang is held in place by an assembly force supplied by the binding screws securing the conductor in the conductor-receiving channel. The assembly force mechanically interlocks each lug cap with the lug body and, by pressing each conductor toward the base of its corresponding conductor-receiving channel, interlocks the fingers of the tang with the lug body.

In addition, the extruded tangs of the invention reduce the manufacturing costs for the multi-conductor lay-in electrical connector and expand the flexibility for its use. In certain embodiments of the invention, the mounting holes of the attachment pad are created during the extrusion process so that the tang may be formed without the need for additional machining or drilling thereby decreasing the expense of the manufacturing processes.

Figure 6:
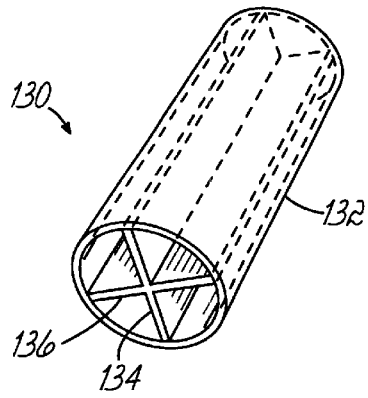
FIG. 6 is a perspective view of a removable plug according to the principles of the invention.

With reference to FIGS. 2 and 6, a disposable plug element or sleeve 130 is positioned within conductor-receiving channel 32 of the electrical connector 10 before conductor 18 is positioned within channel 32. It is appreciated by a person of ordinary skill in the art that each of the conductor-receiving channels 32, 34, 36, 38 may be provided with one of the sleeves 130. The sleeve 130 is formed from any suitable material including, but not limited to, a polymer resin. The sleeve 130 permits the electrical connector 10 to be stored and transported in a pre-assembled state, after manufacture, in which the lug body 12, lug caps 14 and tang 16 are mechanically coupled as an assembly. In the depicted embodiment, the sleeve 130 includes a generally cylindrical, tubular side wall 132 and a pair of rectangular support members 134, 136 extending diametrically between differing portions of the side wall 132. An upper curved surface of the sleeve 130 is contacted by a leading tip of each of the binding screws 70, 71 and a lower curved surface of the sleeve 130 contacts tine 74 of the tang 16. The support members 134, 136 mechanically strengthen the side wall 132 to prevent collapse of the sleeve 130 when a radial force is applied to the side wall 132 by the binding screws 70, 71.

The force applied by the binding screws 70, 71 to the sleeve 130 prevents, during storage and shipment, sliding movement of the respective lug cap 14 relative to the lug body 12 and/or disassociation of the tang 16 from lug body 12. At the point of installation, the lug cap 14 and sleeve 130 are removed from the lug body 12. After removal of sleeve 130, the tip of the binding screws 70, 71 are spaced from the tine 75 of the tang 16 by a distance to provide sufficient clearance for re-engaging the lug cap 14 with the lug body 12 while the conductor 18 is present in conductor-receiving channel 32 and without repositioning the binding screws 70, 71 to clear the exterior of the conductor 18 as the lug cap 12 is re-engaged with lug body 12. It is appreciated that the sleeve 130 may have other alternative constructions, such as a vertical post extending between the respective tips of the binding screws 70, 71 and the tine 74, without departing from the spirit and scope of the invention. It is also contemplated by the invention that the sleeve 130 may be utilized in other types of lay-in electrical connectors, including those having removable lug caps and also lacking a removable tang.

In use, the lay-in electrical connector 10 is pre-assembled by mechanically coupling each of the lug caps 14 and the tang 16 with the lug body 12 using a sufficient number of sleeves 130 corresponding to the number of lug caps 14. At the point of installation, the attachment pad 72 of the lay-in electrical connector 10 is mounted with conventional fasteners to a device, such as a transformer, capable of being energized. The sleeve 130 is removed from the conductor-receiving channel 34 and the corresponding lug cap 14 is removed. The stripped end of the conductor 18 is positioned in the conductor-receiving channel 34 and the lug cap 14 is re-engaged with the lug body 12. The binding screws 70, 71 are advanced using a suitable driving tool to press the conductor 18 against tine 75 of the tang 16. The sleeve 130 may be discarded after removal. The sequence is repeated to place conductors 18 in each of the remaining conductor-receiving channels 34, 36, 38.

The sleeve operates to reduce labor costs associated with installation and simplifies the installation process. In particular, the sleeve permits the electrical connector to be shipped in a pre-assembled state, yet each lug cap is captivated by the sleeve with the lug body. In addition, the sleeve positions or suspends the associated binding screws in a withdrawn position ready for securing a conductor in the corresponding conductor-receiving channel. It is appreciated that the removable plug may be utilized with any electrical connector having one or more removable lug caps associated with a lug body.

With continued reference to FIG. 6, detents or tabs 140, 142 may provided at one longitudinal end of each lug cap 14. The tabs 140, 142 project outwardly in opposite transverse directions from respective upper corners of lug cap 14. It is understood by a person of ordinary skill that the lug cap 14, depicted as engaged with conductor-receiving channel 32 of the lug body 12, may be engaged with one of the other conductor-receiving channels 34, 36, 38. The tabs 140, 142 contact respective side edges of corresponding ones of the outer dividing walls 22, 24 and inner dividing walls 26, 28, 30. The tabs 140, 142 prevent unintentional or inadvertent sliding disengagement of the lug cap 14 from the lug body 12 in situations in which the electrical connector 10 is mounted with the conductor-receiving channels 32, 34, 36, 38 oriented vertically. As shown in FIG. 6, the tabs 140, 142 prevent sliding movement of the lug cap 14 in a direction away from the attachment pad 72.

While the present invention has been illustrated by a description of various embodiments and while these embodiments have been described in considerable detail, it is not the intention of the Applicants to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of Applicants' general inventive concept. The scope of the invention itself should only be defined by the appended claims, wherein we claim:

What I claim is:

1. A lay-in electrical connector comprising:

an electrically-conductive body member having a plurality of dividing walls defining a plurality of conductor-receiving channels each capable of receiving a conductor;

a plurality of cap members each formed of an electrically-conductive material and each engaged with adjacent pairs of said dividing walls, each of said cap members having a binding screw capable of being tightened to capture the conductor in said conductor-receiving channel; and an electrically-conductive tang configured to be removably engaged with said body member, said tang having an attachment pad with at least one mounting hole and a plurality of fingers extending from a side edge of said attachment pad, each of said plurality of fingers being positioned in a corresponding one of said conductor-receiving channels when said tang is engaged with said body member, and said binding screw of each of said plurality of cap members capable of applying a force to a corresponding one of said plurality of fingers and the conductor received within the corresponding one of said conductor-receiving channels for securing said tang to said body member when said binding screw is tightened.

2. The electrical connector of claim 1 wherein said tang is formed by an extrusion process separately from said body member.

3. The electrical connector of claim 2 wherein said body member and said cap members are formed by an extrusion process.

4. The electrical connector of claim 2 wherein said tang, said body member and said cap members are extruded from an aluminum alloy.

5. The electrical connector of claim wherein said at least one mounting hole in said attachment pad is formed during the extrusion process that forms said tang.

6. The electrical connector of claim 2 wherein said tang is extruded from an aluminum alloy.

7. The electrical connector of claim 1 wherein said fingers of said tang are configured to be inserted into and removed from said conductor-receiving channels when said cap members are removed from said body member.

8. The electrical connector of claim 1 wherein said tang, said body member and said plurality of cap members are free of welded joints.

9. The electrical connector of claim 1 wherein said tang includes a plurality of connecting members each interconnecting adjacent pairs of said fingers to provide a plurality of openings each sized to be positioned about one of said dividing walls when said tang is engaged with said body member.

10. The electrical connector of claim 1 wherein each of said conductor-receiving channels of said body member includes a slotted passageway extending generally parallel to the corresponding one of the conductor-receiving channels, said passageway positioned to receive a corresponding one of said fingers.

11. The electrical connector of claim 1 wherein each of said plurality of cap members is engaged removably with a corresponding pair of said plurality of dividing walls.

12. The electrical connector of claim 1 wherein each of said plurality of cap members includes an opposed pair of side edges and a pair of side flanges each extending outwardly from one of said pair of side edges, and said adjacent ones of said dividing walls include confronting channels each configured to receive a corresponding one of said side flanges.

13. The electrical connector of claim 12 wherein each channel includes a downwardly-facing cam surface angled with a downward inclination angle, and each side flange has an upwardly-facing cam surface inclined with an upward inclination angle complementary to said downward inclination angle of a corresponding one of said cam surfaces of said channels.

14. A lay-in electrical connector comprising:

a body member having a conductor-receiving channel capable of receiving a conductor;

a cap member removably received in a portion of said conductor-receiving channel, said cap member having a binding screw capable of being tightened to secure the conductor positioned in said conductor-receiving channel; and a plug element removably positioned in said conductor-receiving channel, said plug element configured to be contacted by said binding screw for captivating said cap member with said body member and removed from said conductor-receiving channel when the conductor is received therein.

15. The electrical connector of claim 14 further comprising a tang having an attachment pad with at least one mounting hole and a finger extending from a side edge of said attachment pad, said tang being configured to be removably engaged with said body member, and said finger being captivated within said conductor-receiving channel by said plug element.

16. The electrical connector of claim 14 wherein said plug element has a tubular side wall and is positioned in said conductor-receiving channel with a centerline of said tubular side wall approximately parallel to a longitudinal axis of said conductor-receiving channel.

17. The electrical connector of claim 16 wherein said plug element includes a plurality of support members disposed inside said tubular side wall, said support members extending diametrically for connecting differing interior portions of said tubular side wall.

18. An apparatus for a lay-in electrical connector having a body member with a conductor-receiving channel capable of receiving a conductor and a cap member removably received in the conductor-receiving channel, said apparatus comprising:

a plug element dimensioned to be positioned removably within one of said conductor-receiving channels, each of said plug elements being contacted by said binding screw for captivating said cap member with said body member and removed from said conductor-receiving channel when the conductor is received therein.

19. The apparatus of claim 18 wherein said plug element has a tubular side wall and is positioned in a conductor-receiving channel with a centerline of said tubular side wall approximately parallel to a longitudinal axis of the conductor-receiving channel.

20. The apparatus of claim 19 wherein said plug element includes a plurality of support members disposed inside said tubular side wall, said support members extending diametrically for connecting differing interior portions of said tubular side wall.

21. A method for securing a cap member and a body member of a lay-in electrical connector, comprising:

providing a lay-in electrical connector having a body member with a conductor-receiving channel and a removable cap member engaged with the body member, the cap member having a threaded binding screw, and the body member having, when the cap member is removed from the body member, a pathway for placing a conductor in the conductor-receiving channel;

inserting a removable plug element into the conductor pathway, the removable plug element having a dimension approximately equal to a circumference of the conductor-receiving channel;

advancing the binding screw relative to the cap member to contact the removable plug element with a force sufficient for securing the cap member with the body member;

removing the removable plug element from the conductor-receiving channel; and inserting the conductor into the conductor-receiving bore and advancing the binding screw to contact the conductor.

22. The method of claim 21 wherein the step of advancing further includes limiting the advance of the tip of the binding screw such that the cap member can be disengaged from the body member before a conductor is placed in the conductor-receiving channel and re-engaged with the body member with the conductor present in the conductor-receiving channel without moving the binding screw relative to the conductor.

23. The method of claim 21 wherein the electrical connector further includes a tang configured to be removably coupled with said body member, and further comprising placing a portion of the tang into the conductor-receiving channel before the steps of inserting and advancing so that the force applied by the binding screw also secures the tang with the body member.

* * * * *

UNITED STATES PATENT AND TRADEMARK OFFICE

CERTIFICATE OF CORRECTION

PATENT NO. : 6,663,443 B1
DATED : December 16, 2003
INVENTOR(S) : Smith et al.

It is certified that error appears in the above-identified patent and that said Letters Patent is hereby corrected as shown below:

Title page,
Item [73], Assignee, change "Ilson" to -- Ilsco --.

Column 9,
Line 3, delete the words "What I claim is:"
Line 39, insert -- 2 -- after the word "claim."

Signed and Sealed this

Eighth Day of March, 2005

JON W. DUDAS
*Director of the United States Patent and Trademark Office*